US005782476A

United States Patent [19]

Fardie

[11] Patent Number: 5,782,476

[45] Date of Patent: Jul. 21, 1998

[54] SNOWBOARD BINDING MECHANISM

[76] Inventor: Kenneth W. Fardie, 100 Lake Shore Dr. L-1, North Palm Beach, Fla. 33408

[21] Appl. No.: 746,967

[22] Filed: Nov. 19, 1996

Related U.S. Application Data

[63] Continuation-in-part of Ser. No. 615,683, Mar. 13, 1996, Pat. No. 5,584,492.

[51] Int. Cl.[6] ..... A63L 9/00

[52] U.S. Cl. ..... 280/14.2; 280/618

[58] Field of Search ..... 280/607, 617, 280/618, 633, 634, 14.2

[56] References Cited

U.S. PATENT DOCUMENTS

| | | | |
|---|---|---|---|
| 5,236,216 | 8/1993 | Ratzek | 280/14.2 |
| 5,261,689 | 11/1993 | Carpenter et al. | 280/14.2 |
| 5,354,088 | 10/1994 | Vetter et al. | 280/618 |
| 5,362,087 | 11/1994 | Agid | 280/611 |
| 5,409,244 | 4/1995 | Youry | 280/14.2 |
| 5,417,443 | 5/1995 | Blattner | 240/14.2 |
| 5,505,478 | 4/1996 | Napoliello | 280/14.2 |

*Primary Examiner*—Richard M. Camby
*Attorney, Agent, or Firm*—McHale & Slavin

[57] ABSTRACT

An adjustable snowboard binding assembly which can be rotatably controlled without the use of external tools. A snowboard boot mounting platform has a plurality of inwardly facing radial teeth along the circumference of a centralized circular cutout. A circumferential lip along the cutout is used to rotatably mount the platform via overlapping lipped quadrant segments which mount to the snowboard. A pair of radially sliding segments with teeth at their outer ends are slidably held-by said quadrant segments. A slidable band is mounted via actuating/locking levers along the longitudinal length of the snowboard, with said band having upwardly extending posts which interface with angled slots formed in each sliding segment. In operation, the actuating levers are unlocked and the band slides forwards and backwards to effectuate radial movement of the sliding segments. This in turn effectuates locking engagement and disengagement between the radial circumferential teeth and the sliding segment teeth. This adjustment operation can be performed by the user without removing the boot from the mounting platform and without loosening screws or other attachment means.

14 Claims, 7 Drawing Sheets

SNOWBOARD BINDING MECHANISM

This patent is a continuation-in-part of Ser. No. 08/615,683 having a filing date of Mar. 13, 1996 now U.S. Pat. No. 5,584,492.

FIELD OF INVENTION

This invention relates to a snowboard binding mechanism which can be conveniently rotated and locked at any angle relative to the board without removing the boot from the binding and without the need for external tools.

BACKGROUND OF THE INVENTION

Snowboarding is a relatively new sport which can be visually compared to skateboarding and surfing, except its done on snow. Snowboard skiing is the legal name for snowboarding, which thereby affords snowboarding all the privileges and liabilities of alpine skiing. To snowboard, the rider stands on the board with his/her left or right foot forward, facing one side of the board. The feet are attached to the board via high-back or plate bindings which are non-releasable. Although there is at least one manufacturer of releasable bindings, they are not widely used. Moreover, the sport is distinct from monoskiing, wherein both feet are side by side on a single ski and the skier faces forward.

Snowboarding has gained in popularity only during the last 10 years. It was pioneered in the late 1970's by a small group of individuals with credit going to Jake Burton and Tom Sims. Both individuals now head snowboard manufacturers, with Burton being the largest snowboard manufacturer in the world. Burton has been frequently attributed with credit for having developed the first high-back bindings and metal edged boards. The roots, however, really started with the "snurfer" which was a sledding toy shaped like a small water ski, with rope tied to the nose and a rough surface for traction running from the center to the back where the user stood. Burton was involved with snurfer racing and was the first to put a foot retention device on his boards. Accordingly, Burton and his boards began to regularly win these events and an industry was born. Today there are more than 65 snowboard equipment manufacturers of boards, boots, and bindings. The cost of snowboard equipment is very comparable to ski equipment with a wide range of costs and types.

Snowboarding is now prevalent on virtually all downhill ski slopes worldwide. In 1985 only 7 percent of ski areas allowed snowboards; today more than 90 percent allow snowboards, and over half have specialized snowboard areas referred to as half pipes. A half pipe is a trough cut or built up with snow, with the term originating from skateboarding. Today about 10 percent of the world skier population consists of snowboarders, with the annual growth rate for the sport projected at 20 percent. In the United States, about 80 percent of snowboarders are male with an average age of 20.8 years. The average snowboarder rides 15 days a year which is 3 times that of the average skier. The PSIA (Professional Ski Instructors of America) and CSF (Canadian Snowboard Federation) now certifies snowboard instructors and most resorts which allow boarding will have instructors on staff. Moreover, the National Ski Patrol (NSP) and Canadian Ski Patrol (CSP) are actively integrating snowboards into their rescue programs.

Accordingly, major competitions utilizing snowboarding equipment are continually being organized involving major sponsorships, television coverage, and world-class athletes with snowboarding also soon to be an Olympic event. Such competitions range from downhill speed runs to slalom races to half-pipe and freestyle performances. As a result, four major categories of boards have been developed including race, alpine, all-around/free-riding, and half-pipe/freestyle.

Two types of bindings are commonly used in snowboarding: the high-back and the plate. The high-back is characterized by a vertical plastic back piece which is used to apply pressure to the heel-side of the board. This binding has two straps which go over the foot, with one strap holding down the heel and the other holding down the toe. Some high-backs also have a third strap on the vertical back piece called a shin strap which gives additional support and aids in toe side turns. The plate, or step-in binding, is used with a hard shell boot much like a ski binding except it is non-releasable.

For different events, the desired angle of the binding relative to the longitudinal axis of the board might need to be changed. For instance, during speed runs such as Giant Slalom (GS) the snowboarder would prefer to have his feet oriented more relatively straight ahead. For other events such as freestyle, the desired angle would be oriented more perpendicular to the longitudinal axis. From Transworld Snowboarding the average stances of pro riders from different snowboarding disciplines are as follows with width in inches, angles in degrees with 0 degrees being perpendicular to the longitudinal axis, center being inches back from center, and length in cm:

| | stance width | front angle | rear angle | center | board length |
|---|---|---|---|---|---|
| Half-pipe: | 20.7 | 17 | 2 | 0.5 | 152.5 |
| Freeride: | 21.1 | 22 | 7 | 1.7 | 170 |
| Slalom: | 17 | 49.2 | 47.2 | 0.4 | 156.8 |
| GS | 17 | 49.6 | 47.6 | 0.44 | 164.9 |
| Super G | 17.16 | 49.4 | 47.4 | 0.45 | 170.5 |
| SlopeStyle | 21.3 | 12 | 0 | 1 | 152.9 |

Presently, snowboard bindings cannot be rotated and locked at different angular positions without using external tools. Bindings use either inserts or retention plate securement methods. Inserts consist of a nut built into the board with a machine screw then used to secure the binding. With the retention plate system, a sheet metal screw is used after tapping a hole into the board. It is referred to as plate retention because a metal plate is built into the board where the board will be tapped. The two most popular binding hole patterns include the Burton 3D and the F2 4×4. Each pattern provides 4 different positions or settings for stance adjustment of each binding. The majority of non-Burton boards use the 4×4 pattern.

However, with each securement and hole pattern method the user must first remove the boot from the binding and then loosen the series of screws—typically with a screwdriver—so the binding can be rotated and positioned at the desired angle. The loose screws must be retightened to lock the binding in place and the user can then reinsert the boot into the binding. Such an operation is difficult, time consuming, and inconvenient for the snowboarder. It would be impractical to require a snowboarder to perform such a field operation on their snowboard. This is particularly true given the high cost of ski-lift tickets and the overall desire by riders to maximize the number of runs performed during any given day.

Most people who use snowboards recreationally prefer to have their front foot positioned at a large angle (e.g. approximately 45 degrees or more) with respect to the longitudinal axis of the snowboard. After snowboarding down the slope, the user typically releases their rear boot and pushes along with the free foot to move the snowboard. Such action is similar to that provided by a skateboarder to move forward on flat surfaces, and hence is called "skating." If enough speed can be achieved via skating, the snowboarder can "glide" by placing the rear foot on the stomp pad which is attached between the bindings where the rear foot can be set when it is not in the rear binding. However, unlike skateboarding where both feet are free, the snowboarder's front foot is fixed at an awkward and inconvenient angle thereby making it difficult to achieve efficient forward locomotion.

Additionally, the inconvenient angle of the user's foot poses a problem when the snowboarder boards and dismounts the ski lift. When sitting down and extending the legs forward, the angle of the mounted foot causes the snowboard to interfere with adjacent passengers on the ski lift. This causes the snowboarder to uncomfortably twist their foot and/or leg and/or body sideways to compensate for the angle of the snowboard. This is particularly unacceptable in light of the long ride time of 15 minutes or more found on most ski lifts. Moreover, such twisting and contorting by the snowboarder might increase the chance of passengers or equipment falling from the lift.

Not only is this situation dangerous and annoying for fellow passengers on the ride up, it is also dangerous upon reaching the disembarkment point on the lift. Due to the unnatural orientation of the snowboarder's mounted foot, it may be difficult for the snowboarder to dismount the lift along the typical straight and narrow path found at most unloading points. Any deviation or lack of control can cause the snowboarder to careen into other patrons, and/or into dangerous obstacles like lift equipment. Moreover, if the snowboarder falls into the path of other disembarking patrons, the whole lift must be stopped until the snowboarder can collect himself and move out of danger.

Accordingly, a snowboard binding is needed wherein the mounting angle relative to the longitudinal axis of the board can be easily adjusted, through any angle, without the need for external tools. This will allow the snowboarder to adjust his foot for different angles for making runs under different conditions. Such a binding will also allow the snowboarder to quickly adjust his mounted foot to a forward facing angle at the end of a run. This will thereby facilitate more efficient and controllable forward locomotion through skating and gliding motions, and also eliminate interference of the snowboard with adjacent fellow passengers on ski lifts.

SUMMARY OF THE INVENTION

The present invention teaches a snowboard binding that can be conveniently rotated and locked at any angle without removing the boot from the binding and without the need for external adjustment tools. The embodied invention uses a stainless steel band which runs along the longitudinal axis of the snowboard and which can be moved fore and aft via a lever located at each end of the band. Alternatively, a single slidable lever or handle can be used on one end of the stainless steel band, whereby the band would run along the longitudinal axis from the lever or handle to the center of the binding mechanism. The binding platform contains a circular cutout with radial, inwardly facing teeth along the outer circumference of the cutout. A pair of toothed segments with outwardly facing radial teeth are connected to the slidable band so that they move outward to engage the teeth on the cutout circumference. The toothed segments are held in place by adjacent quadrant segments which are bolted to the board, and which in turn hold the rotatable platform onto the board.

Under these arrangements, the mounted foot can be rotated through any angle by the user without having to remove the boot and loosen any screws. Instead, the single or dual lever or handle means are actuated and the band is slid forwards or backwards to slidably disengage the toothed segments from the circumferential teeth on the cutout. The binding platform can then be rotated to any angle and be locked into position by re-actuating the lever and sliding the band to cause slidable engagement between the toothed segments and cutout teeth.

Accordingly, it is an object of the present invention to provide a snowboard binding which can be rotatably adjusted without removing the mounted boot and without the use of external tools.

It is yet another object of the present invention to provide a snowboard binding which utilizes a slidable bar actuated by a single or dual lever/handle which pivots or slides for controlling the releasable rotation of the binding platform.

It is still another object of the present invention to provide a snowboard binding which utilizes a circular cutout with radially oriented teeth for engaging and disengaging toothed segments which slide in connectable conjunction with the slidable bar.

It is a further object of the present invention to provide a snowboard binding which utilizes a set of quadrant attachment pieces for attaching the rotatable platform to the board.

It is yet another object of the present invention to provide a series of adjustable stops to conveniently position the binding at predetermined angles.

It is still a further object of the present invention to provide an adjustable binding which is comparable in height to present bindings.

Yet another object of the present invention is to provide a protective plastic covering over the mechanism to protect it from snow.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention has been described in terms of a specific embodiments, it will be readily apparent to those skilled in this art that various modifications, rearrangements and substitutions can be made without departing from the spirit of the invention. The scope of the invention is defined by the claims appended hereto.

Figure 1:
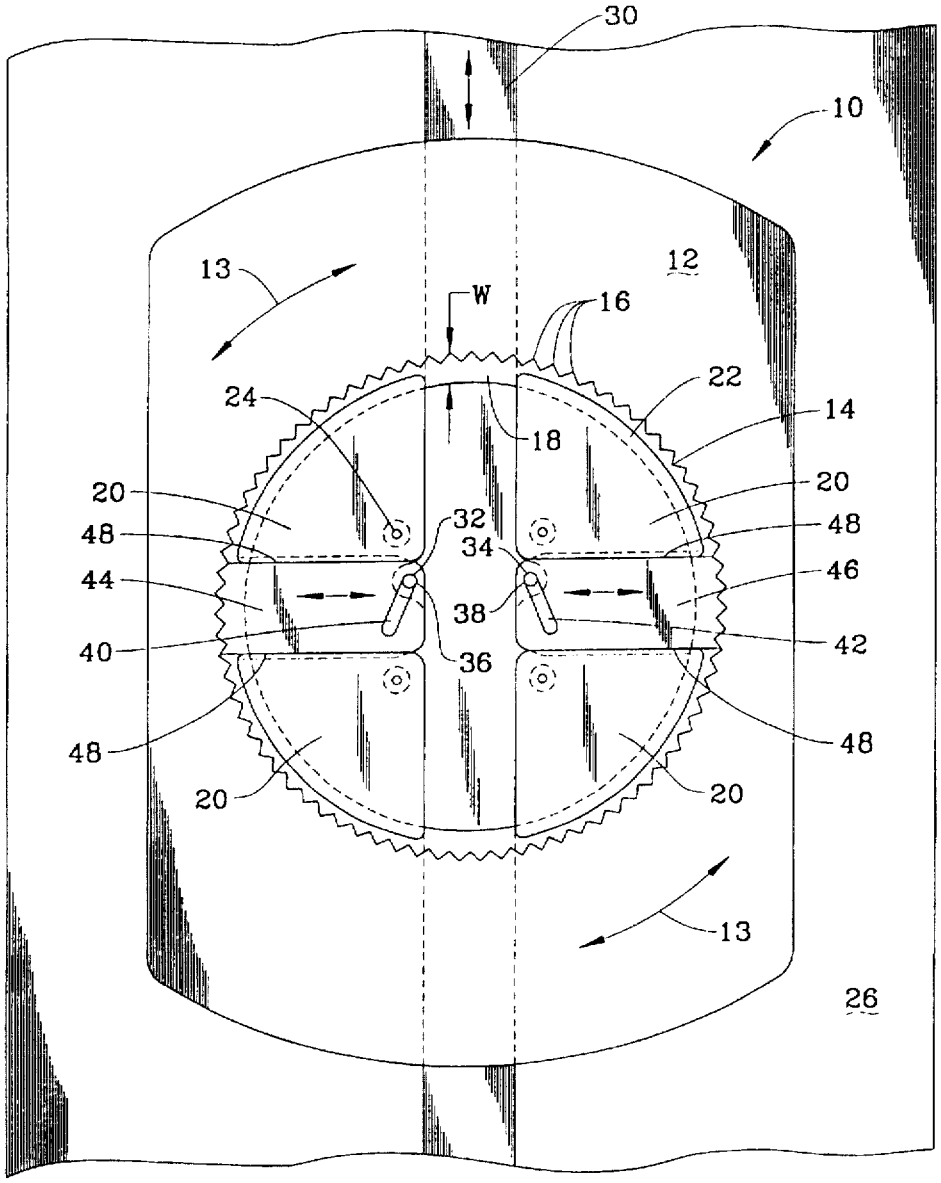
FIG. 1 shows a top view of the rotatable binding assembly.

Referring now to FIG. 1, a top view of the embodied snowboard binding assembly 10 is shown with certain edges in phantom for clarity. The binding platform 12 has a circular cutout 14 in its relative center which has radially oriented teeth 16 along its circumferential edge. In practice, each tooth is oriented approximately two degrees apart along the circumference of cutout 14. Cutout 14 additionally includes a lip 18 which runs along the inner circumferential edge and extends inward a width w. A set of four triangular-shaped quadrant sections 20 each have a corresponding tongue section 22 which is positioned over the lip 18. Each quadrant section 20 is then bolted to the board 26 via an attachment means 24 which includes a traditional insert and machine screw arrangement, or a hole is tapped into a retention plate formed inside the board and the quadrant section 20 is attached with a sheet metal screw. With the circular lip 18 and tongue 22 arrangement between the binding platform 12 and each quadrant section 20, the platform 12 is free to rotate through 360 degrees as shown by arrows 13 and yet remain secured to the board.

A relatively thin, yet strong stainless steel band 30 runs along the longitudinal length of the board 26 and under the center of mounted binding platform 12. This band 30 is designed to slide forwards and backwards along the longitudinal length of the board 26 as facilitated by an attachment lever, at one end of the binding (not shown, see FIG. 3). The band 30 has two laterally extending tabs 32 and 34, and each tab has an upwardly projecting post 36 and 38. A pair of slidably mounted, toothed segments 44 and 46 interact with the posts 36, 38 via angled receiving slots 40 and 42. Each segment 44, 46 is slidably mounted via rails 48 located on either side surface of the segments 44, 46. These rails 48 are received by a corresponding track 49 (see FIG. 2) in each quadrant section 20. Hence, as each quadrant section 20 is bolted to the board 26, the sections 44, 46 are also slidably attached to the board, with the slots 40 and 42 receivably engaging the posts 36, 38. The quadrant sections 20 are also mounted on either side of band 30 as a guide down the center of the board.

In operation, the forward and backward movement of the band 30 causes the posts 36, 38 to engage the angled slots 40, 42. As embodied, when the band 30 is moved forward, the toothed sections 44, 46 slide inward and disengage from the circumferential teeth 16. This allows the binding platform 12 to freely rotate. When the platform 12 is in its desired position, the band 30 is slid backwards which causes the sections 44, 46 to slide outwards. The radial, outwardly facing teeth on sections 44, 46 then re-engage the circumferential teeth 16 on the binding platform, thereby locking the assembly in place.

Figure 2:
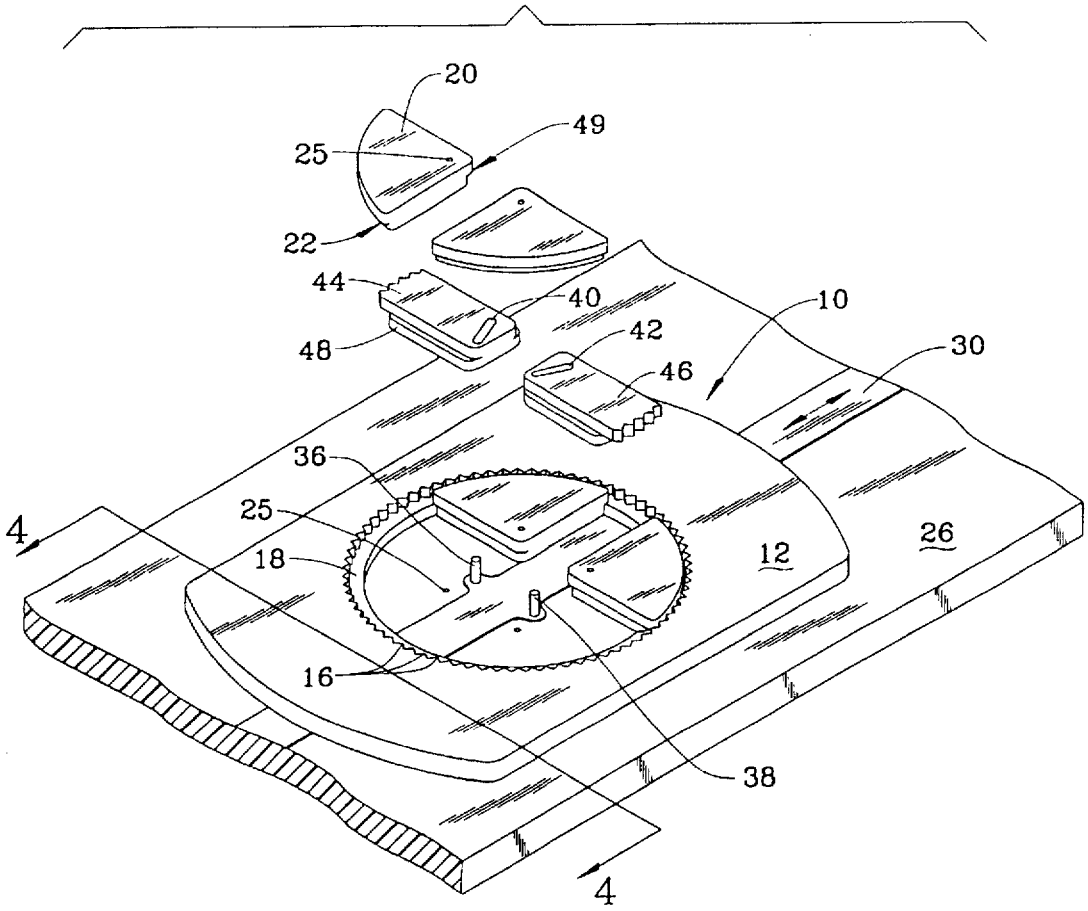
FIG. 2 shows a perspective, partially exploded view of the rotatably binding assembly.
Figure 2A:
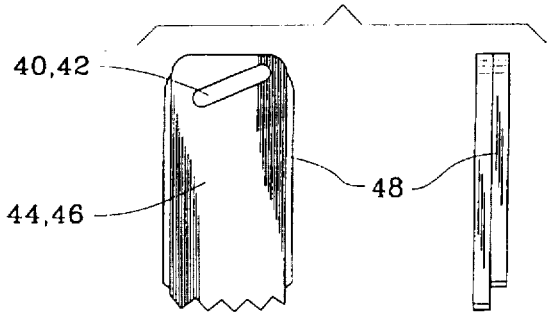
FIG. 2A shows a top and side view of the sliding toothed section of FIG. 2.

Referring now to FIG. 2, a pictorial view of the binding assembly 10 is shown with certain parts displayed in exploded fashion. As detailed above, the binding platform 12 is rotatably mounted on board 26 via attachment with quadrant sections 20. The tongue 22 shown to fit over circular lip 18, while the track 49 receivably engages the rail 48 on each side of the quadrant section 20. The angled slots 40, 42 are shown to receivably fit over posts 36, 38. When an attachment means is placed through attachment holes 25, the platform 12 is free to rotate when the sections 44, 46 disengage from teeth 16. FIG. 2A shows a front and side view of the slidable toothed sections 44, 46 with the rails 48. Attachment of sections 20 also slidably secures sections 44, 46 to the assembly 10.

Figure 3:
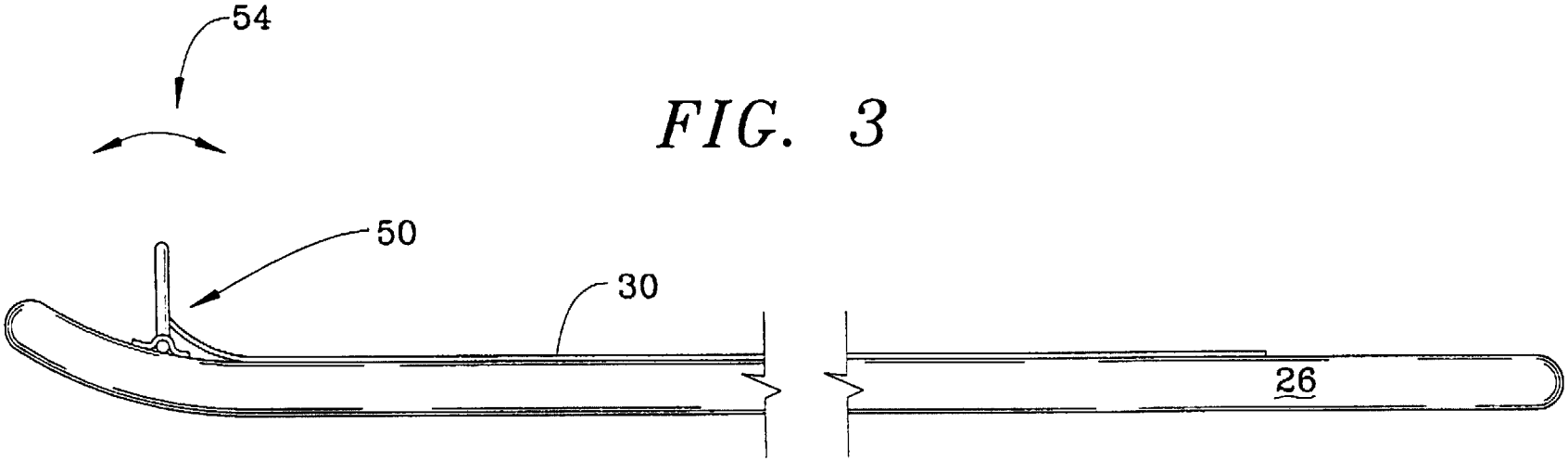
FIG. 3 shows a side view of the snowboard, with the center binding assembly excluded, which shows the sliding center bar and release levers.

Referring now to FIG. 3, a side view of the board 26 is shown with the center section omitted. The stainless steel band 30 runs along the top and is slidably controlled by a lever 50. This lever might include any means capable of slidably controlling and locking the band 30, with the embodied levers being of the "over center"type. Hence, lever 50 must be actuated as shown by arrows 54 for the band 30 to move fore or aft. Also, the lever must be locked when the assembly is properly positioned.

Figure 4:
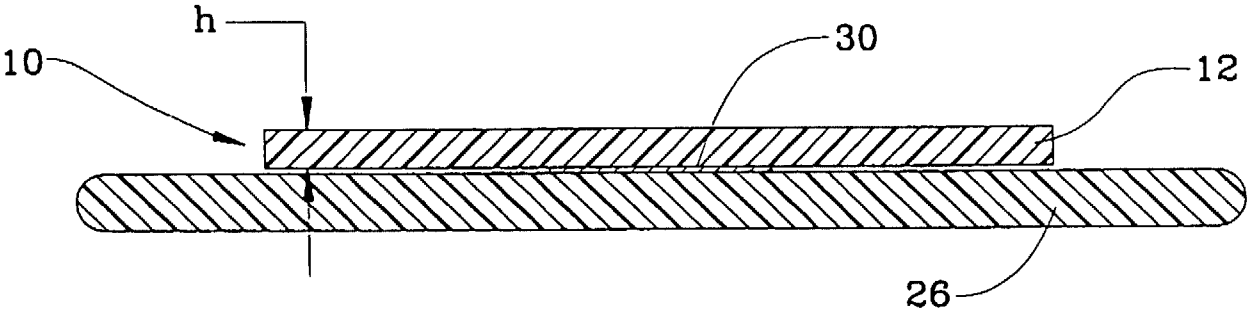
FIG. 4 shows a cross-sectional view of the snowboard and binding assembly along cut 4—4 of FIG. 2.

Referring now to FIG. 4, a cross sectional view of the snowboard 26 and binding assembly 10 are shown along cut 4—4 of FIG. 2. As shown, the steel band 30 runs underneath the binding platform 12. The binding platform 12 is securely mounted to board 26 as described above, yet retains enough play to rotate over the surface of the board 26 and the underlying band 30. The band 30 is also held and guided by the binding assembly parts 10, yet remains free to slidably move fore and aft to thereby adjust the angle of the binding platform 12. Adjustable stops could also be included so that desired angles could conveniently be located and locked in with repeatability by the user.

Furthermore, a thin, flexible plastic covering can be installed over the top of the assembly to protect it from snow and damage from the user's boot. Construction of the longitudinal band would include a stamp cut from a thin stainless steel sheet. The remaining assembly parts including the quadrant sections 20, the platform 12 and the toothed sections 44, 46 would be constructed of high strength plastic. Together, the assembly parts 10 form a rotatable mechanism which is adjustable without the need for external tools, but which presents a height h between the boot and board which is comparable to presently used, conventional bindings. Bindings such as ROSSIGNOL for instance have a height h of approximately less than 0.5 inches. The binding assembly 10 is also symmetrical and can be mounted for either left or right facing stances.

Figure 5:
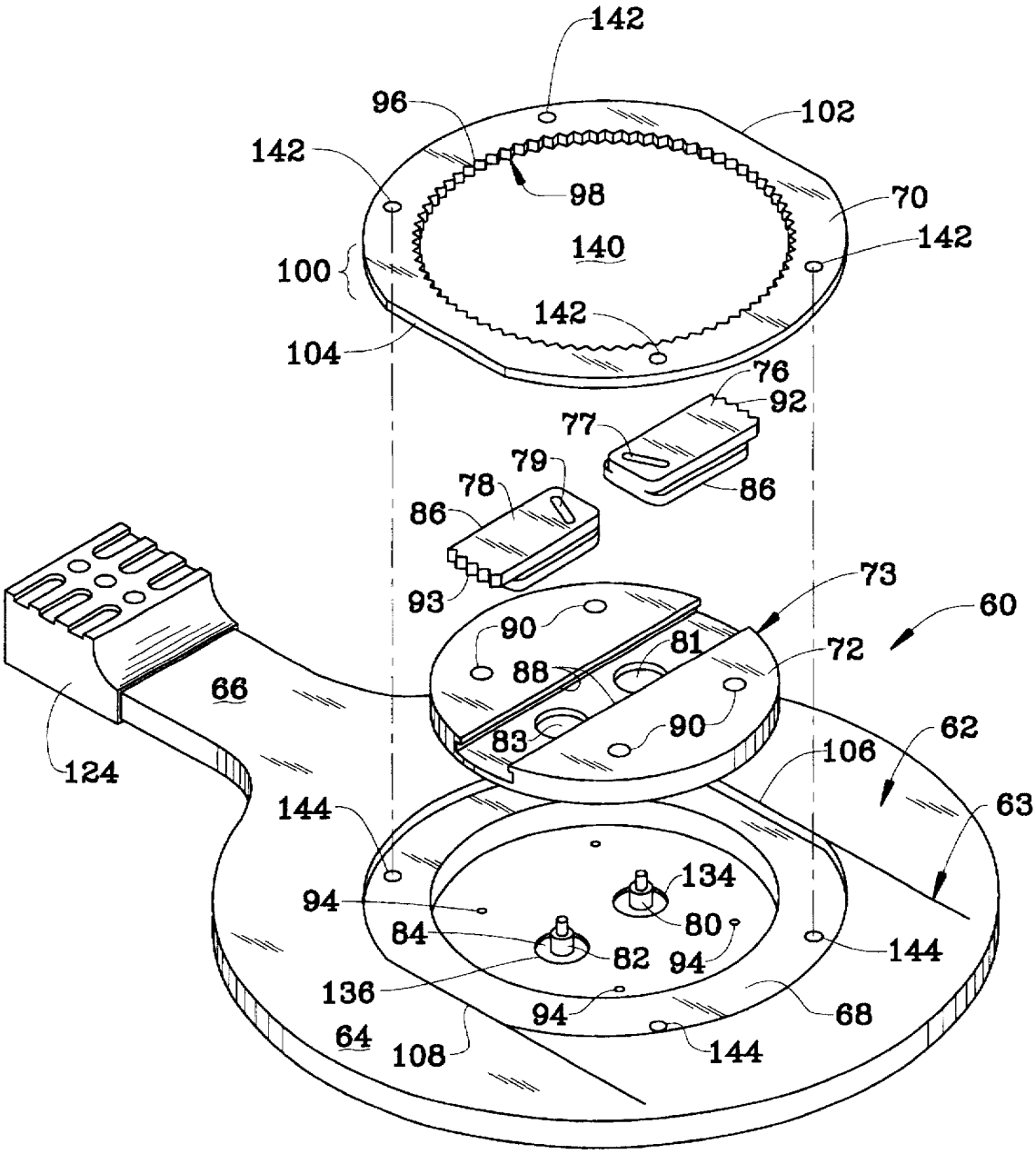
FIG. 5 shows a perspective, partially exploded view of an alternative rotatable binding assembly with a sliding lever handle at one end.

FIG. 5 shows yet another embodiment of the snowboard binding assembly 60. In this embodiment, the binding platform 62 is paddle-shaped with a central portion 64 and a neck 66. A boot mounting fixture 63 rotatably rests on top of the binding platform 62. The binding platform 62 and mounting fixture 63 are typically formed of durable, high impact plastic. A circular insert 68 is fitted in the mounting fixture 63 for receiving a toothed ring insert 70. The insert 68 and ring 70 are formed from metal in the preferred embodiment, but might be formed from other such durable materials. A circular cutout area 69 is formed in the mounting fixture 63 through to the binding platform 62 below. A central anchoring insert 72 is used to slidably anchor the mounting fixture 63 to the assembly platform 62, which is then mounted onto the underlying snowboard (not shown).

The anchoring insert 72 includes a central channel 74 for receiving a pair of slidably mounted, toothed segments 76 and 78. The toothed segments each have oblong through holes 77 and 79 for receiving posts 80 and 82 which extend upward from the top surface of a steel band 84 which runs underneath the assembly (See FIG. 6, described below). A pair of holes 81 and 83 extend through the anchoring insert 72 to allow the posts 80, 82 to extend upwards into the holes 77, 79.

The toothed segments 76, 78 each have rails 86 which extend from each side of the segments. The rails operatively interact with a groove 88 which is formed in either side of the channel 74. The segments 76, 78 are then slidably mounted in the anchoring insert 72 by sliding the segments 76, 78 into either end of the channel 74 with the rails 86 slidably fitting into the grooves 88.

The anchoring insert 72 also has an outer diameter 73 which is slightly larger than the inner diameter 71 of the circular insert 68. A series of four mounting holes 90 in the anchoring insert 72 are aligned with a corresponding set of four holes 94 in the assembly platform 62. Various mounting devices might be used through the holes including screws, rivets, or nut and bolt combinations for attaching the anchoring insert 72 to the assembly platform 62. When the outer diametric edge 73 of the anchoring insert 72 is secured over the circular insert 68 the boot mounting fixture 63 is thereby rotatably attached to the assembly platform 62.

The toothed ring 70 has a thickness 100 and an inner diameter 98 with a toothed inner surface 96 facing inwards. The edges 102 and 104 of the ring 70 are cut off to facilitate mounting of the ring 70 in the boot mounting fixture 63 along edges 106 and 108. A series of four attachment holes 142 in the ring 70 align with corresponding attachment holes 144 in the circular insert 68 for attaching the ring 70 to the insert 68.

Figure 6:
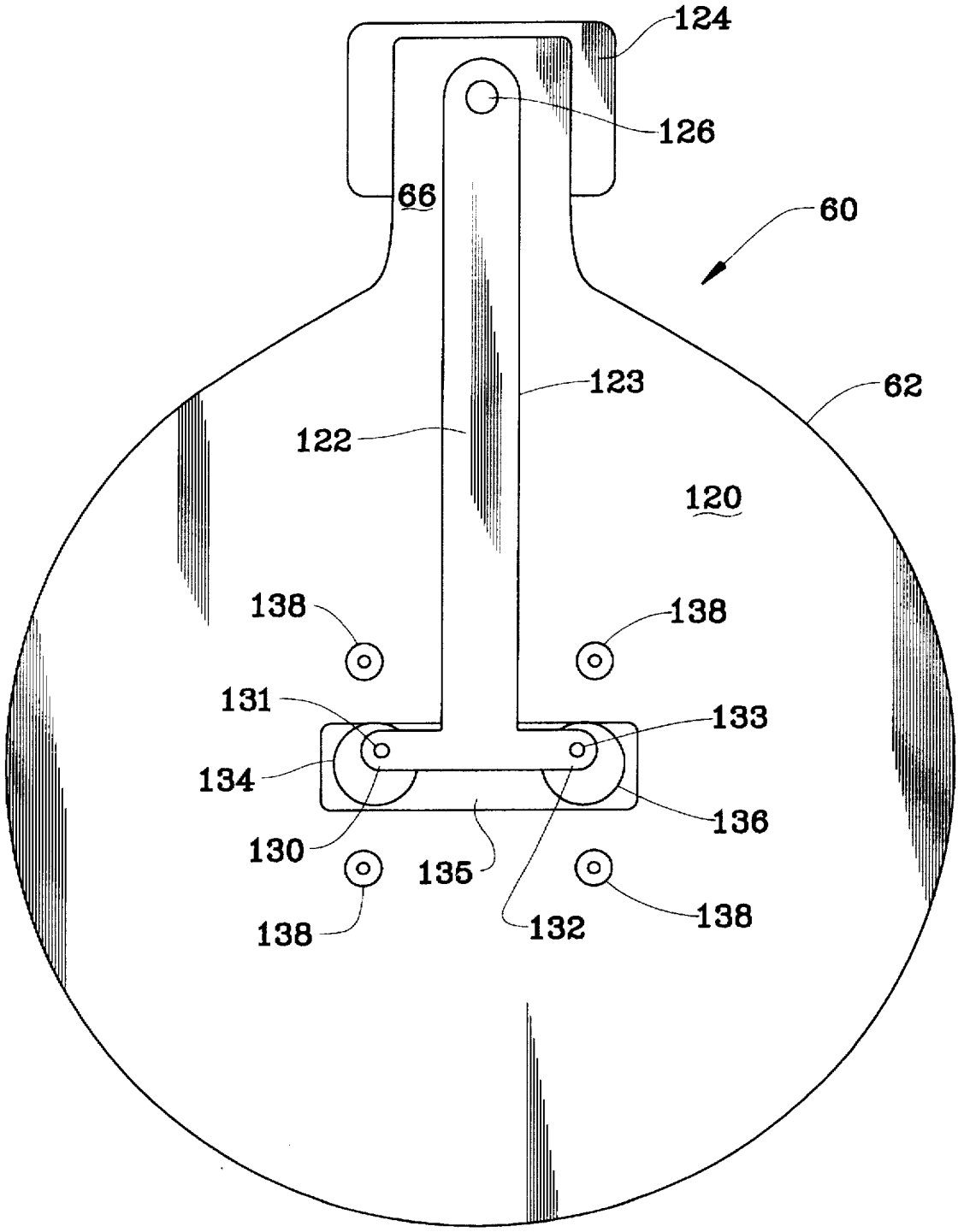
FIG. 6 shows a bottom view of the binding assembly of FIG. 5.

Referring also to FIG. 6, the bottom of the binding assembly 60 is shown. The bottom 120 of the mounting assembly platform 62 includes a T-shaped stainless steel strap 122 running in a channel 123 along the longitudinal length of the platform 62 and along the neck portion 66. The strap 122 is attached at the neck portion via a connector 126 to a handle or lever 124 which slidably interacts with the neck portion 66 of the platform 62. The opposite T-shaped portion 128 of the strap 122 includes a first and second tab 130 and 132. The posts 80 and 82 are respectively mounted via connectors 131 and 133 to the top surface 84 of the steel band 122. The posts 80 and 82 extend upward through holes 134 and 136 formed in the assembly platform 62. The holes 134, 136 are further surrounded by a indentation 135 approximately the thickness of the strap 122 and the channel 123. By embedding the strap 122 in such a channel 123, the bottom of the binding assembly 60 can mount flush against the upper surface of the snowboard. Connectors 138 are also shown which connect the assembly platform 62 to the anchoring insert 72.

To operably assemble the parts of the binding assembly 60, the toothed segments 76 and 78 are slidably inserted into the channel 74 so that the rails 86 and grooves 88 appropriately interfit. The strap 122 and lever/handle 124 are slidably attached onto the bottom 120 of the assembly platform 62 so that the posts 80 and 82 extend upwards through holes 134 and 136. The anchoring insert 72 is then placed over the cutout section 69 in the boot mounting fixture 63, with the holes 81, 83 and oblong cutouts 77, 79 aligned so that the posts 80 and 82 extend through the respective openings. The anchoring insert 72 is attached to the assembly platform 62 via an attachment device being inserted through mounting holes 90 and 94. The toothed ring component 70 is next placed over the anchoring insert 72 so that the central portion 140 encircles the upper portion of the insert 72, with the inner diameter 98 of ring 70 being slightly larger than the outer diameter 73 of the anchoring insert 72. In this configuration, the handle 124 can be moved to slide the bar 122. The posts 80, 82 will thereby move backwards or forwards inside the oblong slots 77, 79 to cause the toothed segments 76, 78 to move inwards and outwards. When the bar 122 is extended to its foremost point, the segments 76, 78 are slidably pushed outwards so that the teeth sections 92 and 93 engage the teeth 96 along the inner diameter of the ring 70. Conversely, when the bar 122 is moved backwards, the segments 76, 78 are slidably pulled inwards via movement of the posts 80, 82. When the segments are pulled inwards the teeth surfaces 92, 93 and 96 are disengaged and the boot mounting fixture 63 can be freely rotated to a new position.

Figure 7:
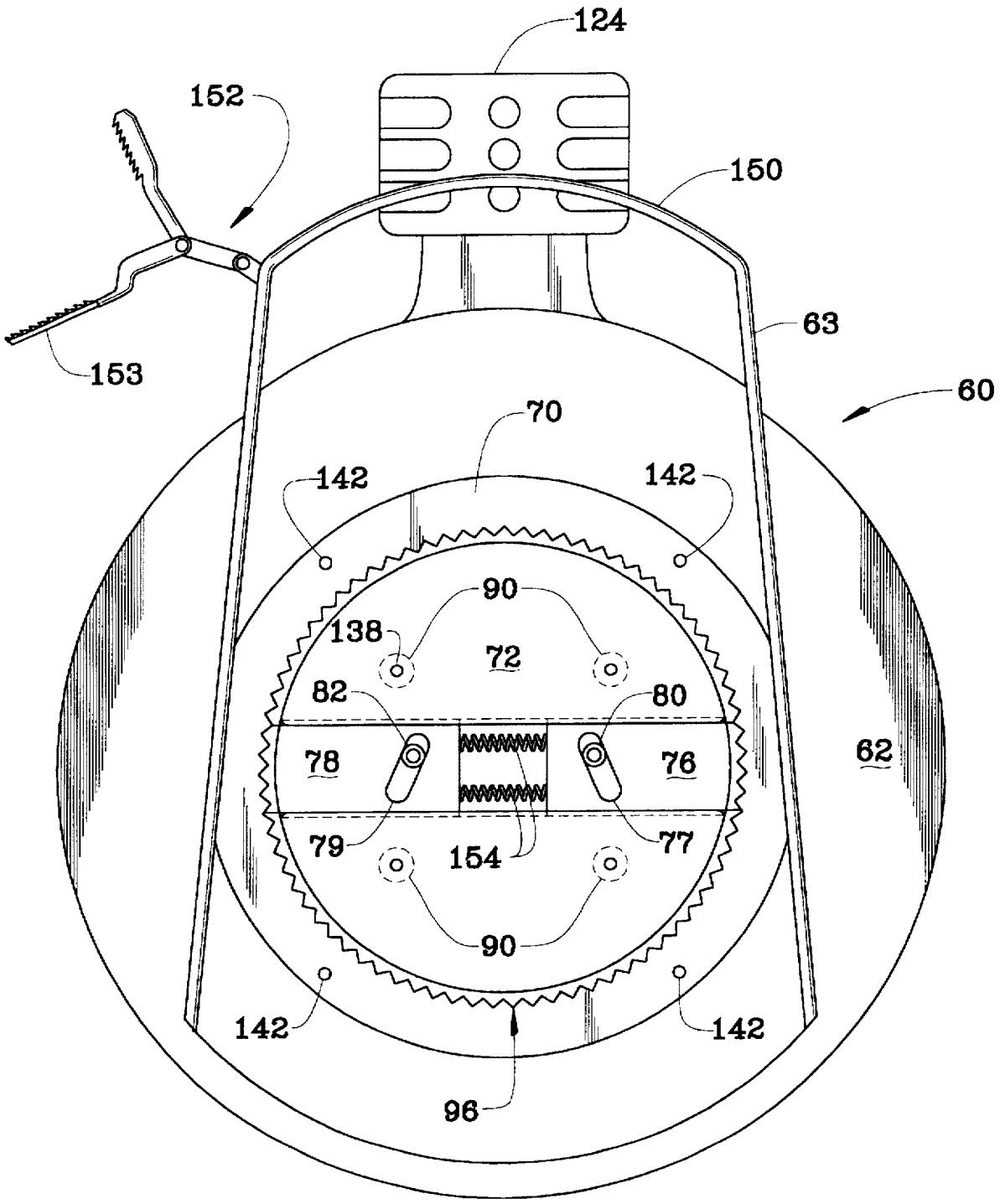
FIG. 7 shows a top view of the binding assembly of FIG. 5 with a boot clamping mechanism further mounted on top.

Referring now to FIG. 7, a top view of the binding assembly 60 is shown, in an assembled condition. The boot mounting fixture 63 is shown positioned on top of the assembly platform 62 and includes a rear boot support 150 and a buckle device 152 and a strap 153. The ski boot is thereby placed in the mounting fixture 63 and strapped in place. The anchoring insert 72 is shown secured to the platform 62 through connectors 138 placed through the mounting holes 90. The toothed segments 76, 78 slidably engage the toothed surface 96 on the ring 70, and include springs 154 attached between the sliding segments 76, 78. The springs 154 provide outward force to push the segments 76, 78 towards a lockably engaged position. The handle 124 can also be spring loaded internally to create a default locked position which must be overcome with sufficient backward pressure on the handle 124.

Figure 8:
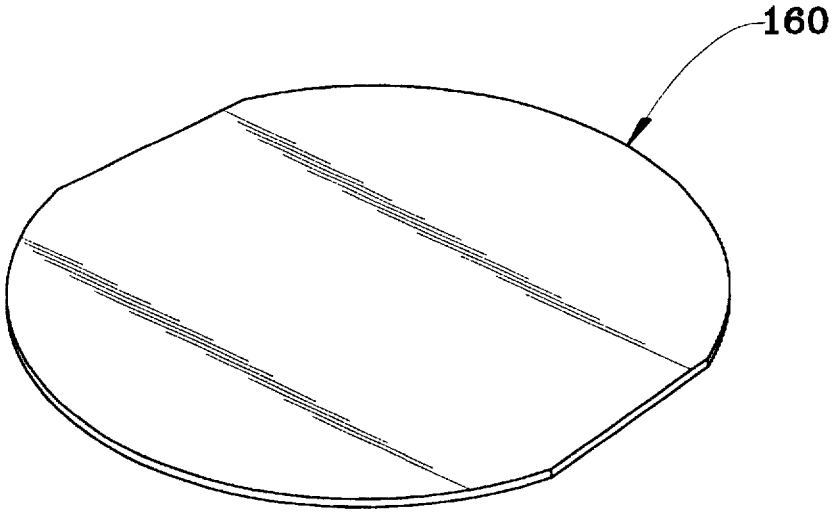
FIG. 8 shows a protective plate which is mounted over the top of the binding mechanism.
Figure 9:
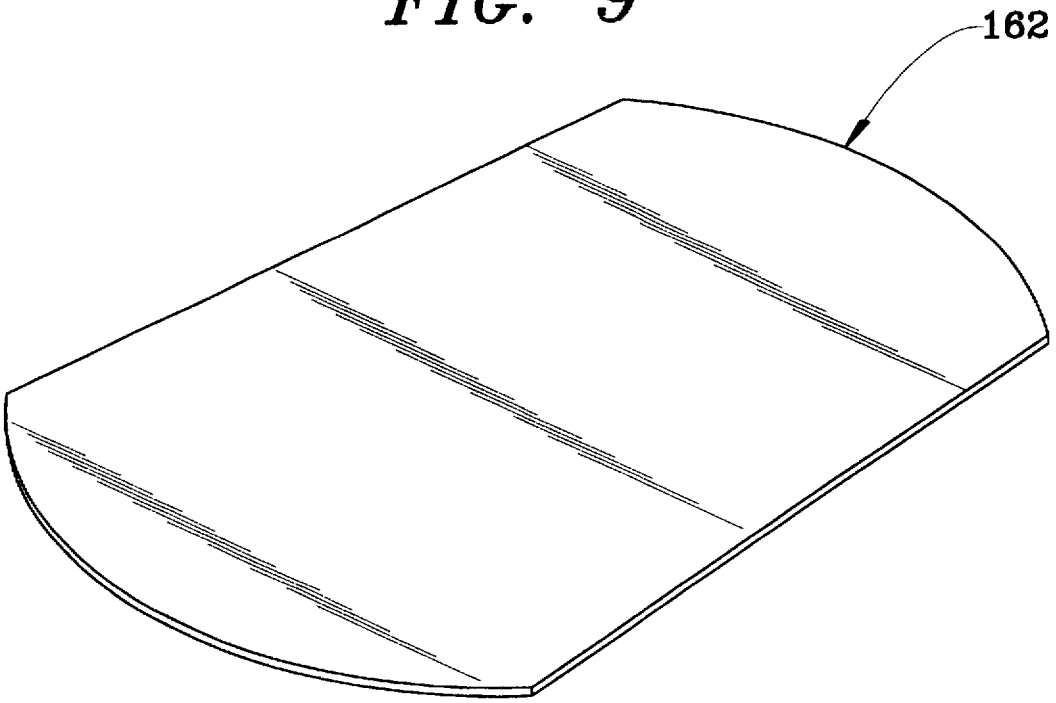
FIG. 9 shows a protective plate which is mounted over the top of the binding mechanism.

Referring also FIGS. 8 and 9, different embodiments of cover plates 160 and 162 are shown which are used to cover and protect the assembled components from contact with the user's boot, as well as snow, ice, and dirt. The cover plates might be formed from durable plastic or metal and can be attached via external attachment devices. The preferred embodiment uses tabs or extensions formed in the plates which frictionally interact with the underlying binding assembly.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and descriptions.

What is claimed is:

1. An adjustable snowboard binding assembly which can be rotated and locked to chosen orientation angles without the use of external tools comprising:

a mounting assembly platform with attachment holes, and a longitudinal length with a central portion and a neck portion;

a rotatable boot mounting fixture with a central cutout and a circular insert having a first inner diameter;

a pair of side segments having guide rails extending laterally along their sides, an angled receiving slot, and an outwardly facing toothed edge;

an anchoring insert with a second outer diameter which overlaps said first inner diameter, said insert having a lateral receiving track for receiving said side segments and said guide rails, and a plurality of attachment holes for an attachment means;

a toothed ring insert with an third inner diameter which encompasses said second outer diameter, having a plurality of radial oriented circumferential teeth along its inwardly facing circumference, and being attached to said circular insert;

a slidable band extending along said longitudinal length of the platform with a pair of laterally extending side tabs, each side tab having an upwardly extending post;

wherein said attachment means attaches said anchoring insert to said platform so that said boot mounting fixture is rotatable held via said overlapping anchoring insert, and said side segments are slidably held via said interfacing rail and track, and said posts are received in said angled slots and thereby control the lateral sliding movement of said side segments via movement of said band so that said teeth on said side segments engage or disengage said teeth on said platform.

2. The adjustable snowboard binding assembly of claim 1, wherein said slidable band includes a slidable handle means on said neck portion of said platform which is manually actuated to achieve slidable movement of said band.

3. The adjustable snowboard binding assembly of claim 1, wherein said plurality of circumferential teeth are oriented to provide 360 degrees of rotation with one degree of resolution between positions.

4. The adjustable snowboard binding assembly of claim 1, wherein said mounting platform, said boot mounting fixture, and said side sections are construction from high strength, cold resistant plastic.

5. The adjustable snowboard binding assembly of claim 1, wherein said slidable band is stamped from stainless steel sheet metal.

6. The adjustable snowboard binding assembly of claim 1, wherein said attachment means includes attachment holes comprised of inserts mounted in said mounting assembly platform with accompanying machine screws for attaching thereto.

7. The adjustable snowboard binding assembly of claim 1, wherein said attachment means includes attachment holes in said mounting assembly platform with accompanying nut and bolt means for attaching components thereto.

8. The adjustable snowboard binding assembly of claim 1, wherein a protective cover is placed over said completed binding assembly.

9. An adjustable snowboard binding assembly which can be rotated and locked to chosen orientation angles without the use of external tools comprising:

a mounting assembly platform with attachment holes;

a boot mounting fixture rotatably attached via a mounting means to said platform with a centralized circular cutout having a plurality of radially oriented inwardly facing circumferential teeth;

a locking handle means with at least two radially sliding segments for interactably engaging said circumferential teeth, said segments being releasably controllable via actuating means attached to the bottom of said mounting assembly platform;

wherein from a locked position said actuating means releases said sliding segments which slidably disengage said teeth on said platform thereby allowing rotation of said fixture to a new position, with said actuating means then being used to slidably re-engage said teeth on said platform and lock said platform into place.

10. The adjustable snowboard binding assembly of claim 9, wherein said locking means includes a pair of side segments having guide rails extending laterally along their sides, an angled receiving slot, and an outwardly facing toothed edge.

11. The adjustable snowboard binding assembly of claim 9, wherein said mounting means includes an anchoring insert with a diameter which overlaps said circular cutout in said boot amounting fixture, and at least one attachment hole for an attachment means.

12. The adjustable snowboard binding assembly of claim 9, wherein said actuating means includes a slidable band extending along the longitudinal length of the snowboard with a pair of laterally extending side tabs, each side tab having an upwardly extending post which is received by said angled receiving slot of said side segment, whereby fore and aft movement of said band interactably caused radial sliding of said side segments.

13. The adjustable snowboard binding assembly of claim 9, wherein said plurality of circumferential teeth are oriented to provide 360 degrees of rotation with one degree of resolution between positions.

14. The adjustable snowboard binding assembly of claim 9, wherein a protective cover is placed over said completed binding assembly.

* * * * *